US009660323B2

(12) United States Patent
Au

(10) Patent No.: US 9,660,323 B2
(45) Date of Patent: May 23, 2017

(54) INDEPENDENT ADJUSTABLE AZIMUTH MULTI-BAND ANTENNA FIXTURE

(71) Applicant: T-Mobile USA, Inc., Bellevue, WA (US)

(72) Inventor: Chad Au, Kirkland, WA (US)

(73) Assignee: T-Mobile USA, Inc., Bellevue, WA (US)

( * ) Notice: Subject to any disclaimer, the term of this patent is extended or adjusted under 35 U.S.C. 154(b) by 109 days.

(21) Appl. No.: 14/671,828

(22) Filed: Mar. 27, 2015

(65) Prior Publication Data

US 2016/0285149 A1 Sep. 29, 2016

(51) Int. Cl.

| | |
|---|---|
| ***H01Q 1/42*** | (2006.01) |
| ***H01Q 1/12*** | (2006.01) |
| ***H01Q 21/28*** | (2006.01) |
| ***H01Q 1/24*** | (2006.01) |
| ***H01Q 3/06*** | (2006.01) |
| ***H01Q 21/26*** | (2006.01) |

(52) U.S. Cl.

CPC ..... *H01Q 1/1264* (2013.01); *H01Q 1/246* (2013.01); *H01Q 1/42* (2013.01); *H01Q 3/06* (2013.01); *H01Q 21/26* (2013.01); *H01Q 21/28* (2013.01)

(58) Field of Classification Search

CPC ..... H01Q 1/42; H01Q 21/28; H01Q 1/1264

USPC ..... 343/758

See application file for complete search history.

(56) References Cited

U.S. PATENT DOCUMENTS

| | | | | |
|---|---|---|---|---|
| 6,861,994 | B2 * | 3/2005 | Desargant | H01Q 3/04 343/705 |
| 7,636,068 | B2 * | 12/2009 | Duk-Yong | H01Q 3/20 343/757 |
| 7,683,845 | B2 * | 3/2010 | Wynn | H01Q 1/421 343/757 |
| 8,497,814 | B2 * | 7/2013 | Puente | H01Q 1/246 343/700 MS |
| 8,836,597 | B1 * | 9/2014 | Vizzio | H01Q 3/04 343/757 |
| 8,890,756 | B2 * | 11/2014 | Tsai | H01Q 3/02 343/757 |
| 2005/0134512 | A1 | 6/2005 | Gottl et al. | |
| 2006/0192717 | A1 | 8/2006 | Kim | |
| 2008/0180338 | A1 | 7/2008 | Duk-Yong | |
| 2009/0135074 | A1 | 5/2009 | Yang et al. | |
| 2015/0070230 | A1 | 3/2015 | Bradley et al. | |

OTHER PUBLICATIONS

The PCT Search Report and Written Opinion mailed Jun. 29, 2016 for PCT application No. PCT/US2016/023619, 15 pages.

* cited by examiner

*Primary Examiner* — Huedung Mancuso

(74) *Attorney, Agent, or Firm* — Lee & Hayes, PLLC

(57) ABSTRACT

A combination antenna fixture is configured to accommodate adjustment of independent azimuths for each frequency band of operation of antennas of a mobile telephone network. The antennas may be mounted within a single radome or housing used to protect the antennas from environmental conditions. Each of the antennas may be coupled to a different movable mounting device within a radome, which may enable directing the azimuth for each antenna independently. By directing the azimuth independently for each antenna, the signal coverage area for each antenna may be customized to optimize coverage over a geographic area.

20 Claims, 7 Drawing Sheets

Section A-A

Section B-B

Section A-A

Section B-B

Section A-A

Section B-B

INDEPENDENT ADJUSTABLE AZIMUTH MULTI-BAND ANTENNA FIXTURE

BACKGROUND

Antenna placement for cell site base stations in a mobile telephone network is important to ensure that mobile devices using the network have connectivity across a geographic area. Antennas are often located at sites that include mounting locations for individual antennas, including element array antennas. However, these sites are expensive and sometimes limited in quantity. In addition, antennas are often installed with a predetermined fixed azimuth, and thus do not allow practical adjustment of the azimuth. Some multi-band antennas are currently available, but they have limitations. Radiation patterns for each frequency band of existing multi-band antennas may have independent down tilt adjustments, but their azimuths are fixed in the same direction.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

Figure 1C:
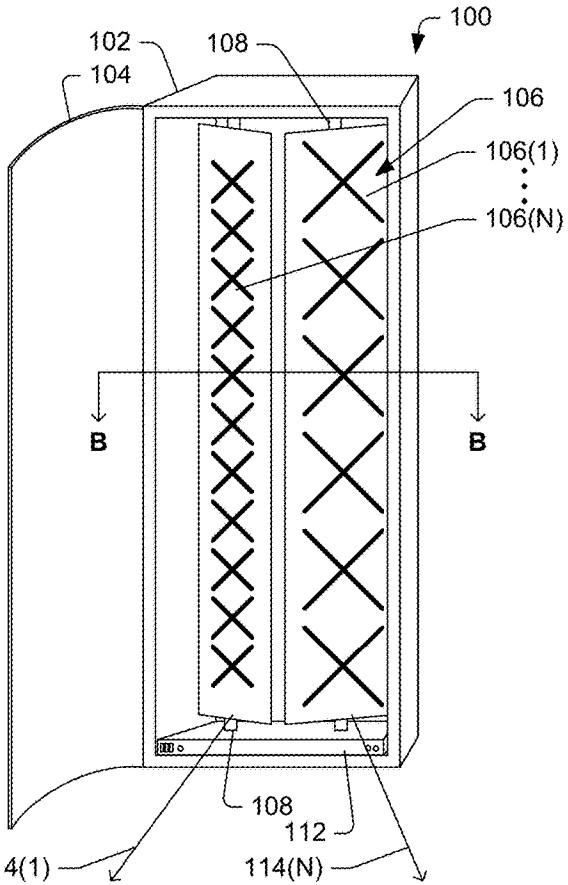
FIGS. 1B and 1C are isometric views of the illustrative antenna fixture showing an interior of the fixture while an access door is open. The antenna fixture includes multiple independently adjustment azimuth multi-band antennas, which are shown in FIG. 1B as directed to a first direction and shown in FIG. 1C as directed to different directions.

This disclosure is directed to a combination antenna fixture configured to accommodate adjustment of independent azimuths for each frequency band of operation of antennas of a mobile telephone network. For example, the combination antenna fixture may include a low-band frequency antenna (e.g., 700/850 MHz) and a mid-band frequency antenna (e.g., 1700/1900 MHz). Each antenna may include orthogonally polarized dipoles and may be configured as element arrays. The antennas may be mounted within a radome or housing used to protect the antennas from environmental conditions. Each of the antennas may be coupled to a different movable mounting device within a radome, which may enable directing the azimuth for each antenna independently. By directing the azimuth independently for each antenna, the signal coverage area for each antenna may be customized to optimize coverage over a geographic area. For example, an antenna may have a first azimuth, which a may set a boresight at a first angle, and thus place a main lobe associated with coverage by the antenna over a first area. By changing first azimuth to a different azimuth, the boresight and location of the main lobe may be modified.

The movable mounting devices may enable rotations of respective antennas, which may modify the azimuth for each antenna. For example, a movable mounting device may rotate about one or more pivots, bearings or collars located at or near opposite ends of a longitudinal axis of the antenna. The movable mounting device may include features to enable manual and/or remote rotation (adjustment) of each antenna, which may modify the azimuth for each antenna independently. The movable mounting devices may each include a position indicator, which may allow manual adjustment of an azimuth to a predetermined angle, possibly without opening the housing/radome. Thus, the position indicator may be at least partially on a knob and partially on a location of the housing near the knob, which shows different positioning indicia. Remote adjustment may be performed by transmitting rotation instructions from switch centers to the antenna fixture where in instructions are included in additional data packets having special control signals. The control signals may cause a controller device for the antenna fixture to cause rotation of an antenna, such as by selectively operating a motor or actuator. For example, it may be desirable to change an azimuth of the low-band antenna and not the mid-band antenna in an existing antenna site when a new low band antenna is installed close by the existing antenna site, thus reducing overlap and/or maximizing coverage density by the low-band antennas. After the azimuth is adjusted for an antenna, the movable mounting device may be secured in the determined position to maintain the azimuth. For example, the movable mounting device may be secured by tightening a fastener, applying a clamp, powering off a stepper motor, and/or by utilizing other mechanical and electromechancial devices.

The apparatuses, techniques and systems described herein may be implemented in a number of ways. Example implementations are provided below with reference to the following figures.

Figure 1B:
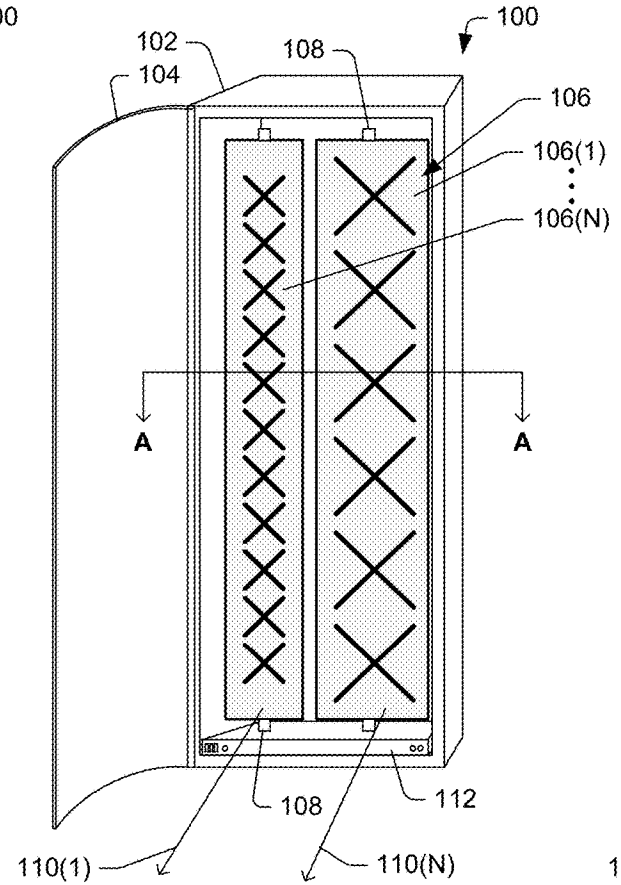
Figure 1A:
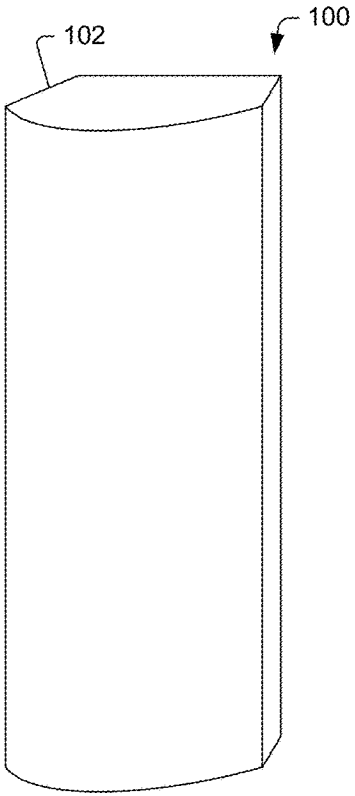
FIG. 1A is an isometric view of an illustrative antenna fixture.

FIG. 1A is an isometric view of an illustrative antenna fixture 100. The antenna fixture includes a radome 102, which acts as a housing for the antenna fixture 100. The radome 102 may be formed of a material that minimally attenuates an electromagnetic signal transmitted or received by antennas with the radome 102. The radome 102 is designed to protect the antennas, controllers, and other contents from weather, to conceal the contents, and for other purposes. The size of the radome may be determined for a specific site, and may have height, width, and depth constraints. Thus, optimization of space within the radome 102 is desirable. As discussed below, use of a movable mounting device may enable independent adjustability of each of two or more antennas within the radome 102, thus making efficient use of space for a particular site.

FIG. 1B is an isometric views of the illustrative antenna fixture 100 showing an interior of the fixture while an access door 104 is open. The antenna fixture 100 includes multiple independently adjustment azimuth multi-band antennas, which are shown in FIG. 1B as directed to a first direction and shown in FIG. 1C as directed to different directions.

Returning to FIG. 1B, the antenna fixture 100 may include multiple antennas 106, which may include a first antenna 106(1) and a second antenna 106(N). However, more antennas may be included in the antenna fixture 100. The antennas may each be adjustably mounted on a movable mounting device 108 that enables setting an azimuth for a respective antenna. As shown in FIG. 1B, the first antenna 106(1) is set to a first azimuth 110(1) while the second antenna 106(N) is set to a second azimuth 110(N).

The antenna fixture 100 may include a controller 112 which may control operation of the antennas and the base station. For example, the controller 112 may adjust a remote electrical tilt (RET) of each antenna. In some embodiments, the controller 112 may receive a control signal from a switch center to cause rotation of an antenna to change the azimuth for that particular antenna without changing the azimuth for another antenna within the antenna fixture 100. In addition, the controller 112 may perform other conventional operations of a base station.

FIG. 1C shows the first antenna 106(1) being set to a third azimuth 114(1) while the second antenna 106(N) being set to a fourth azimuth 114(N), where the third azimuth 114(1) and the fourth azimuth 114(N) are different azimuths. The first antenna 106(1) may be rotated from the first azimuth 110(1) to the third azimuth 114(1) by rotation of one of the moveable mounting devices 108. Likewise, the second antenna 106(N) may be rotated from the second azimuth 110(N) to the fourth azimuth 114(N) by rotation of another one of the moveable mounting devices 108. The rotation of the moveable mounting devices 108 may be performed manually or by actuation of a motor or actuator. For example, the controller 112 may cause a motor to rotate one or more of the movable mounting devices 108.

Figure 1D:
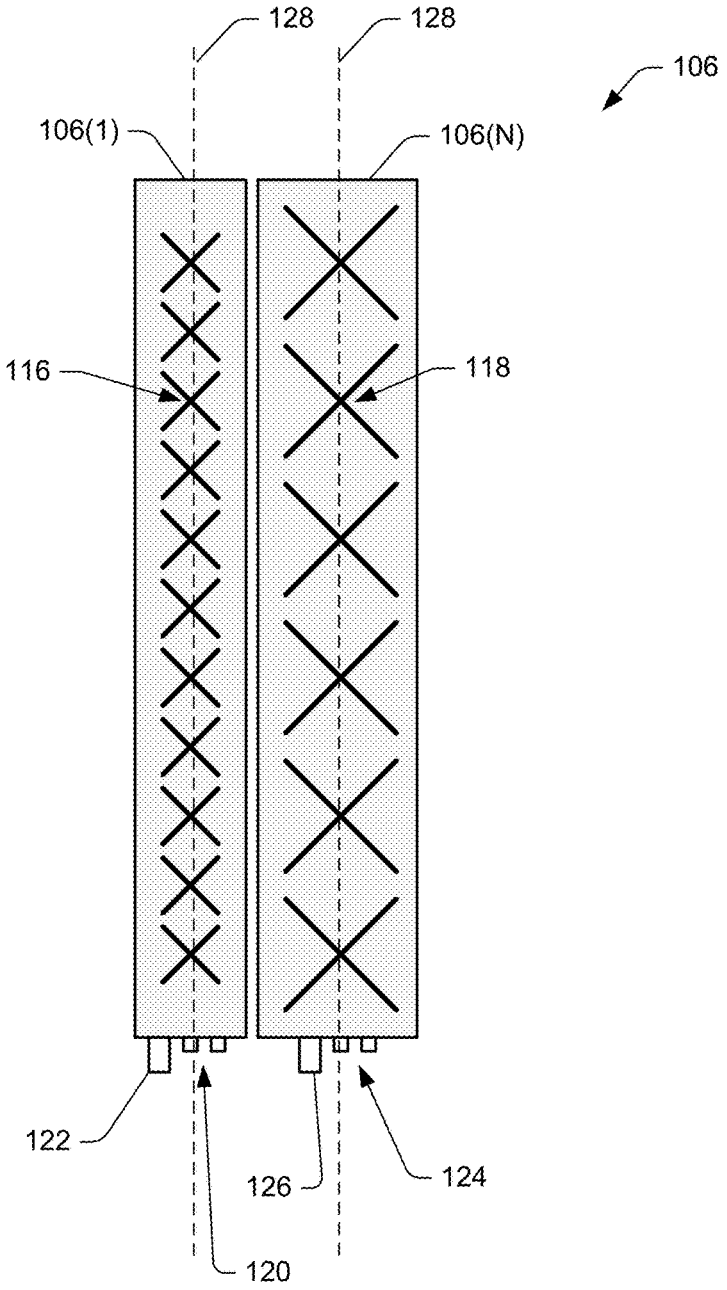
FIG. 1D is a side elevation view of a pair of independent multi-band antennas, which may be contained within the fixture.

FIG. 1D is a side elevation view of the independent multi-band antennas 106, which may be contained within the fixture 100 shown in FIGS. 1A-1C. The first antenna 106(1) may include orthogonal mid-band dipoles 116. The first antenna 106(1) may include mid-band radio frequency (RF) ports 120, which may be in communication with the controller 112. The first antenna 106(1) may include a mid-band RET actuator 122, which may be in communication with the controller 112.

The second antenna 106(N) may include orthogonal low-band dipoles 118. The second antenna 106(N) may include low-band radio frequency (RF) ports 124, which may be in communication with the controller 112. The second antenna 106(N) may include a low-band RET actuator 126, which may be in communication with the controller 112.

The antennas 106 may each include a longitudinal axis 128. The antennas may be rotated about an axis that is parallel to the longitudinal axis 128 to adjust the azimuth of an antenna, as discussed above.

Figure 2A:
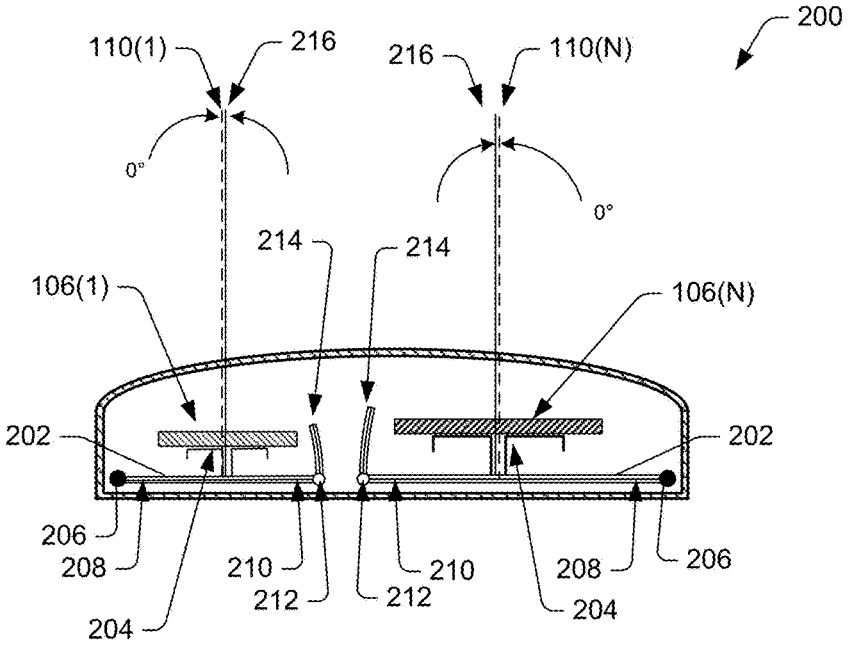
FIGS. 2A and 2B are cross-sectional plan views of the fixture showing a movable mounting device configured to individually rotate each of the antennas.

FIG. 2A is a plan view of a cross section A-A from FIG. 1B. FIG. 2A shows illustrative moveable mounting devices 200 configured to individually rotate each of the antennas 106. The moveable mounting devices 200 may be the same, mirrored versions, or different in some ways, such as in size, width, and/or height. The moveable mounting devices 200 may include a support 202 that enables coupling of one of the antennas to a mount 204. For example, the support 202 may include a "T" shaped mount that couples to the antenna. However, the support 202 may take various forms to accomplish securing the antenna to virtually any shaped mount. The support 202 may rotate about a hinge 206 at a first end 208 of the support 202. A second, opposite end 210 of the support 202 may include a guided feature 212 in contact with a guide 214 that enables controlled rotation of the support 202 and hinge 206 as the guided feature 212 is limited to movement within bounds of the guide 214. In some embodiments, the guided feature 212 may be a wheel or ball, and the guide 214 may be a channel that constrains movement of the feature 212 to a predetermined path (provided by rotation of the hinge). The guide feature 212 may be configured to move between a first position and a second position within the guide 214 that constrains movement of the guiding feature 212 and constrains rotation of the hinge 206. The guided feature 212, the guide 214, or both, may include a securing feature to lock the support 202 in place, and thus fix the azimuth of an antenna at least temporarily at an angle. However, the securing feature may be located in other places to maintain a position/angle of the support 202. As shown in FIG. 2A, the first antenna 106(1) is set to the first azimuth 110(1) while the second antenna 106(N) is set to the second azimuth 110(N). Here, the first azimuth 110(1) and the second azimuth 110(N) may be zero degrees relative to a reference line 216. However, the azimuths may be different degrees.

In various embodiments, the support may be rotated manually, such as by a crank arm or other input device. The hinge, guide, or another part of the fixture may include indicia to indicate an angle of the antenna relative to the reference line or another reference. In some embodiments, the hinge 206 may be a motor or actuator, which may cause rotation of the support 202 and the mounted antenna. However, a motor or actuator may be located in other locations to cause movement of the support 202. For example, the guided feature 212 may be a geared cog driven by a stepper motor, while the guide 214 may be have teeth complementary to the geared cog. Thus, the stepper motor may drive the gear about the track to change the angle of the support 202 and a respective one of the antennas 106.

Figure 2B:
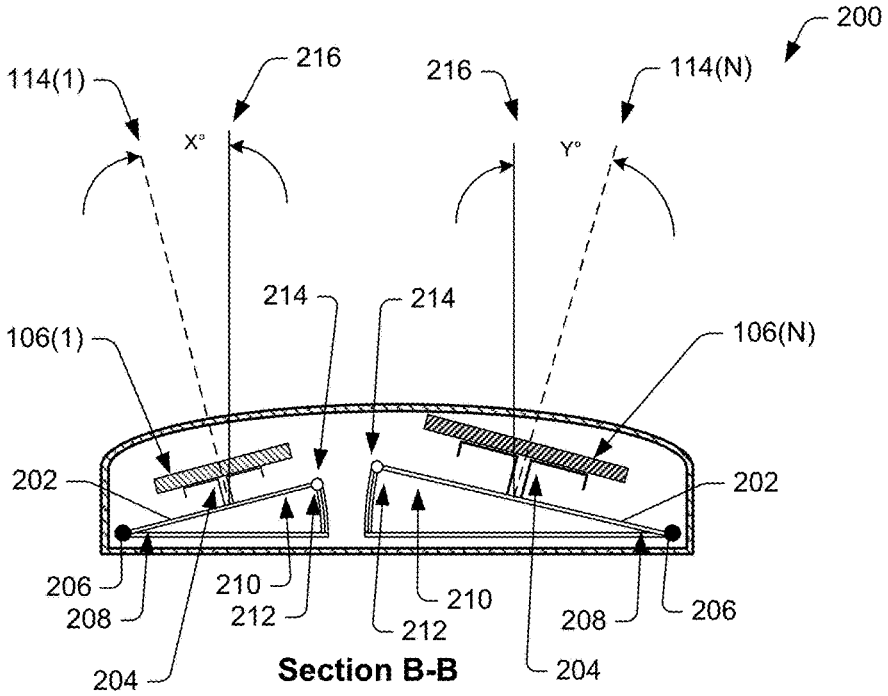

FIG. 2B is a plan view of a cross section B-B from FIG. 1C. FIG. 2B shows rotation of the support 202 about the hinge 206, which results in independent rotation of each of the antennas 106. The first antenna 106(1) is set to the third azimuth 114(1) while the second antenna 106(N) is set to the fourth azimuth 114(N), where the third azimuth 114(1) and the fourth azimuth 114(N) are different azimuths. Here, the third azimuth 114(1) may be positive thirty degrees relative to the reference line 216 while the fourth azimuth 114(N) may be negative thirty degrees relative to the reference line 216. However, the azimuths 114 may be greater or less angles from the reference line 216. As shown the rotation of the first antenna 106(1) may be opposite from the rotation of the second antenna 106(N), which may enable a maximum combined azimuth directions of 114(1) plus 11(N), which in this example may be sixty degrees. Thus, one mounting device may rotate in a clockwise direction while the other mounting device may rotate in a counterclockwise direction. In this configuration, the mounting devices are mirrored versions of one another. In some embodiments, the mounting devices may not be mirror copies, and may rotate in a same direction from the position shown in FIG. 2A to the position shown in FIG. 2B. Of course, the mounting devices enable the supports 202 to rotate back to the position shown in FIG. 2A from the position shown in FIG. 2B.

FIGS. 2A and 2B show embodiments of a bottom side of the fixture 100. The top side of the fixture 100 may include similar or identical features as those described above with respect to FIGS. 2A and 2B, or other devices described here that enable independent rotation of each of the antennas.

Figure 3A:
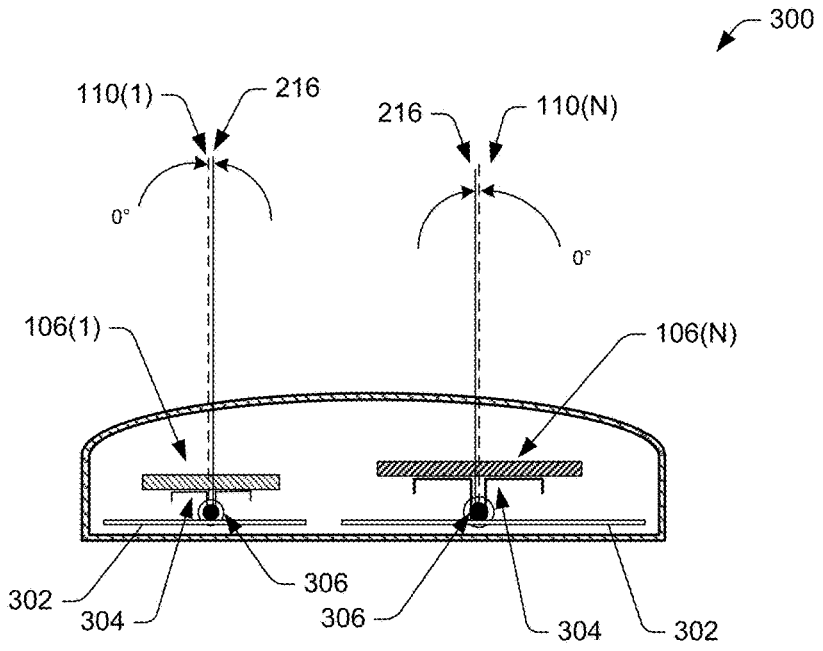
FIGS. 3A and 3B are cross-sectional plan views of the fixture showing another movable mounting device configured to individually rotate each of the antennas.

FIG. 3A is a plan view of a cross section A-A from FIG. 1B. FIG. 3A shows illustrative moveable mounting devices 300 configured to individually rotate each of the antennas 106. The moveable mounting devices 300 may be the same, mirrored versions, or different in some ways, such as in size, width, and/or height. The moveable mounting devices 300 may include a support 302 that enables coupling of one of the antennas to a mount 304. For example, the support 302 may include a "T" shaped mount that couples to the antenna. However, the support 302 may take various forms to accomplish securing the antenna to virtually any shaped mount. The support 302, and thus one of the antennas 106, may rotate about a hinge 306. The hinge 306 and/or the mount may include a securing feature to lock the antenna in place, and thus fix the azimuth at least temporarily at an angle. As shown in FIG. 3A, the first antenna 106(1) is set to the first azimuth 110(1) while the second antenna 106(N) is set to the second azimuth 110(N). Here, the first azimuth 110(1) and the second azimuth 110(N) may be zero degrees relative to the reference line 216. However, the azimuths may be different degrees.

In various embodiments, the mount 304 may be rotated manually, such as by a crank arm or other input device. The hinge 306, mount 304, or another part of the moveable mounting devices 300 may include indicia to indicate an angle of the antenna relative to the reference line or another reference. In some embodiments, the hinge 306 may be a motor or actuator, which may cause rotation of the mount 304 and the mounted antenna. However, a motor or actuator may be located in other locations to cause movement of the mount 304. For example, the motor may be a stepper motor.

Figure 3B:
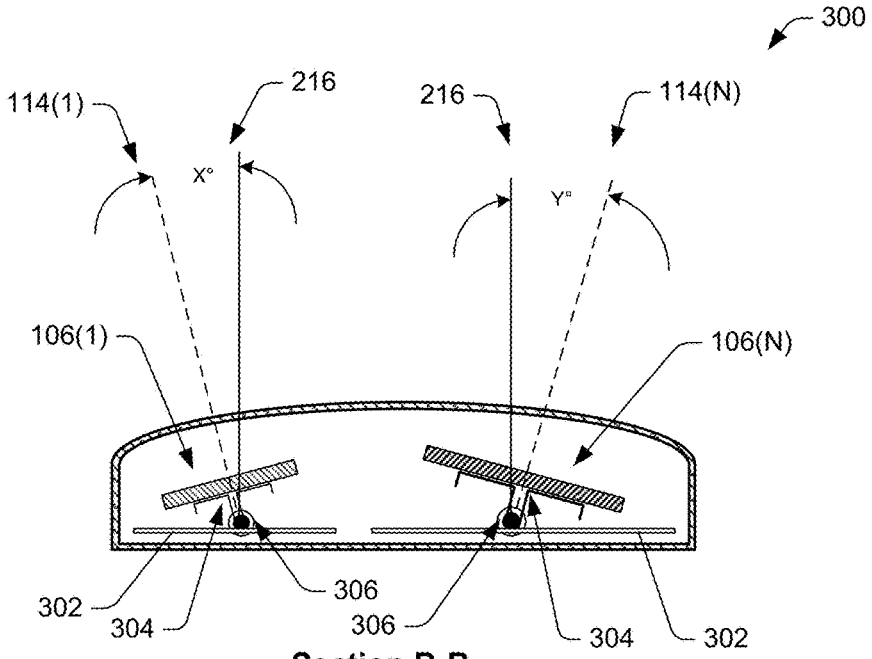

FIG. 3B is a plan view of a cross section B-B from FIG. 1C. FIG. 3B shows rotation of the mount 304 about the hinge 306, which results in independent rotation of each of the antennas 106. The first antenna 106(1) is set to the third azimuth 114(1) while the second antenna 106(N) is set to the fourth azimuth 114(N), where the third azimuth 114(1) and the fourth azimuth 114(N) are different azimuths. Here, the third azimuth 114(1) may be positive thirty degrees relative to the reference line 216 while the fourth azimuth 114(N) may be negative thirty degrees relative to the reference line 216. However, the azimuths 114 may be greater or less angles from the reference line 216. As shown the rotation of the first antenna 106(1) may be opposite from the rotation of the second antenna 106(N), which may enable a maximum combined azimuth directions of 114(1) plus 11(N), which in this example may be sixty degrees.

FIGS. 3A and 3B show embodiments of a bottom side of the fixture 100. The top side of the fixture 100 may include similar or identical features as those described above with respect to FIGS. 3A and 3B, or other devices described here that enable independent rotation of each of the antennas.

Figure 4A:
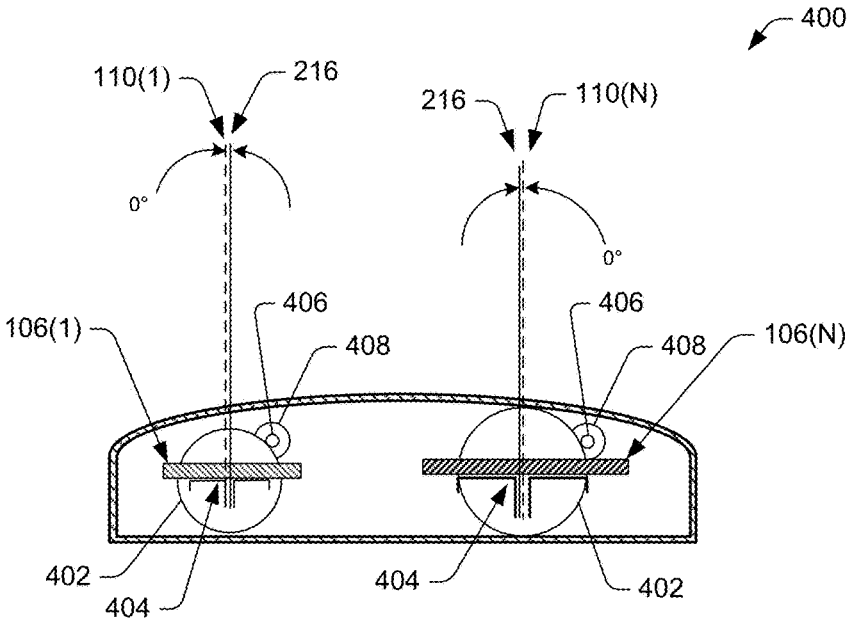
FIGS. 4A and 4B are cross-sectional plan views of the fixture showing yet another movable mounting device configured to individually rotate each of the antennas.

FIG. 4A is a plan view of a cross section A-A from FIG. 1B. FIG. 4A shows illustrative moveable mounting devices 400 configured to individually rotate each of the antennas 106. The moveable mounting devices 400 may be the same, mirrored versions, or different in some ways, such as in size, width, and/or height. The moveable mounting devices 400 may include a support 402 that enables coupling of one of the antennas to a mount 404. For example, the support 402 may be a rotatable disc coupled to a mount 404. The support 402, and thus one of the antennas 106, may rotate about a hinge, pivot, bearing, or other guide enabling rotation of the support 402. The support 402 may include a securing feature to lock the antenna in place, and thus fix the azimuth at least temporarily at an angle. As shown in FIG. 4A, the first antenna 106(1) is set to the first azimuth 110(1) while the second antenna 106(N) is set to the second azimuth 110(N). Here, the first azimuth 110(1) and the second azimuth 110(N) may be zero degrees relative to the reference line 216. However, the azimuths may be different degrees.

In various embodiments, the mount 404 may be rotated manually, such as by a crank arm or other input device. The support, mount 404, or another part of the moveable mounting devices 400 may include indicia to indicate an angle of the antenna relative to the reference line or another reference. In some embodiments, a drive wheel 406 may cause rotation of the support 402, such as by gears that engage teeth arranged around a perimeter of the support 202. A motor 408, such as a stepper motor or other actuator, may cause rotation of the drive wheel 406. However, the motor 408 or actuator may be located in other locations to cause movement of the support 202.

Figure 4B:
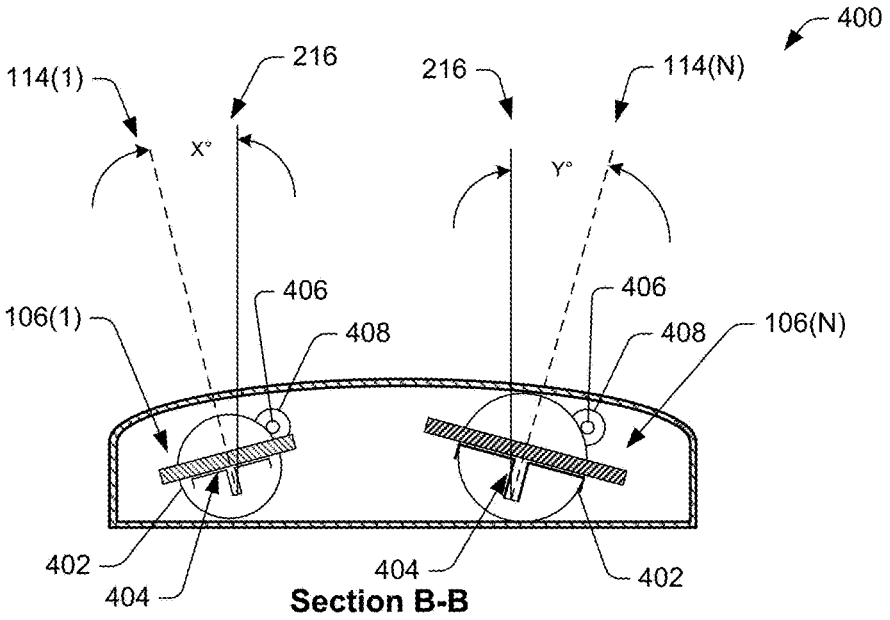

FIG. 4B is a plan view of a cross section B-B from FIG. 1C. FIG. 4B shows rotation of the mount 404, which results in independent rotation of each of the antennas 106. The first antenna 106(1) is set to the third azimuth 114(1) while the second antenna 106(N) is set to the fourth azimuth 114(N), where the third azimuth 114(1) and the fourth azimuth 114(N) are different azimuths. Here, the third azimuth 114(1) may be positive thirty degrees relative to the reference line 216 while the fourth azimuth 114(N) may be negative thirty degrees relative to the reference line 216. However, the azimuths 114 may be greater or less angles from the reference line 216. As shown the rotation of the first antenna 106(1) may be opposite from the rotation of the second antenna 106(N), which may enable a maximum combined azimuth directions of 114(1) plus 11(N), which in this example may be sixty degrees.

FIGS. 4A and 4B show embodiments of a bottom side of the fixture 100. The top side of the fixture 100 may include similar or identical features as those described above with respect to FIGS. 4A and 4B, or other devices described here that enable independent rotation of each of the antennas.

Figure 5:
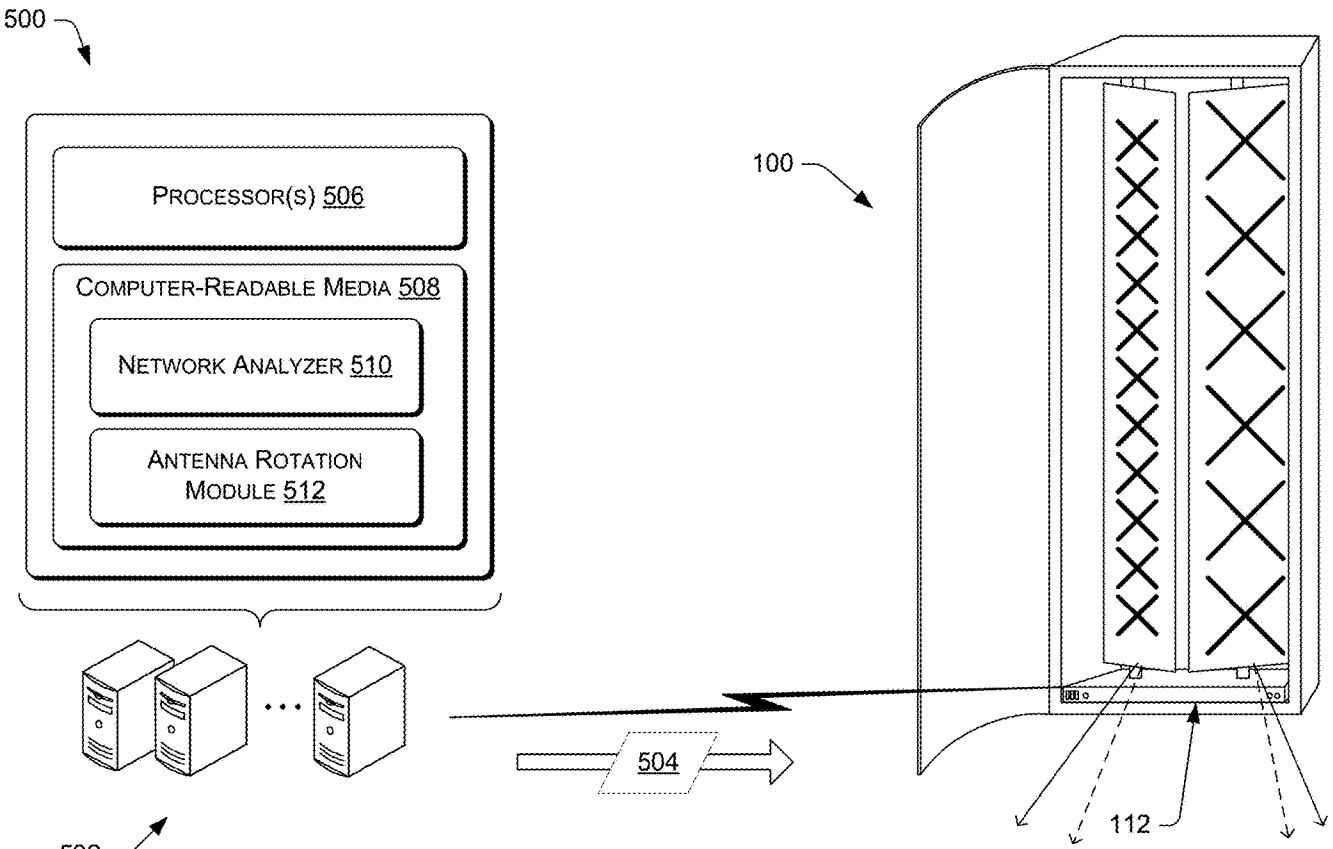
FIG. 5 shows a computing environment to enable remote adjustment of an azimuth of one or more of the antennas.

FIG. 5 shows a computing environment 500 to enable remote adjustment of an azimuth of one or more of the antennas with the fixture 100. The computing environment may include servers 502, which may be associated with a switch center or other control center. The servers 502 may communicate with the controller 112 via packets 504 that include control signals. The packets 504 may be extra packets transmitted to the antenna along with other network data, such as user data. However, the control signals may be transmitted to the controller 112 using a dedicated network and/or by other known techniques. As another example, the control signals may ride as part of the communication path between cell site base station radio equipment and base station controllers back at the switch such that the RET and azimuth controllers are integrated into the base station, and the computing environment is integrated into the base station controllers. The control signals may cause rotation of individual antennas to change an azimuth of an antenna. The servers 502 may be implemented in a distributed or non-distributed computing environment.

The servers 502 may include one or more processors 506 and one or more computer-readable media 508 that stores various modules, applications, programs, or other data. The computer-readable media 508 may include instructions that, when executed by the one or more processors 506, cause the processors to perform the operations described herein for the servers 502.

Embodiments may be provided as a computer program product including a non-transitory machine-readable storage medium having stored thereon instructions (in compressed or uncompressed form) that may be used to program a computer (or other electronic device) to perform processes or methods described herein. The machine-readable storage medium may include, but is not limited to, hard drives, floppy diskettes, optical disks, CD-ROMs, DVDs, read-only memories (ROMs), random access memories (RAMs), EPROMs, EEPROMs, flash memory, magnetic or optical cards, solid-state memory devices, or other types of media/machine-readable medium suitable for storing electronic instructions. Further, embodiments may also be provided as a computer program product including a transitory machine-readable signal (in compressed or uncompressed form). Examples of machine-readable signals, whether modulated using a carrier or not, include, but are not limited to, signals that a computer system or machine hosting or running a computer program can be configured to access, including signals downloaded through networks.

Figure 6:
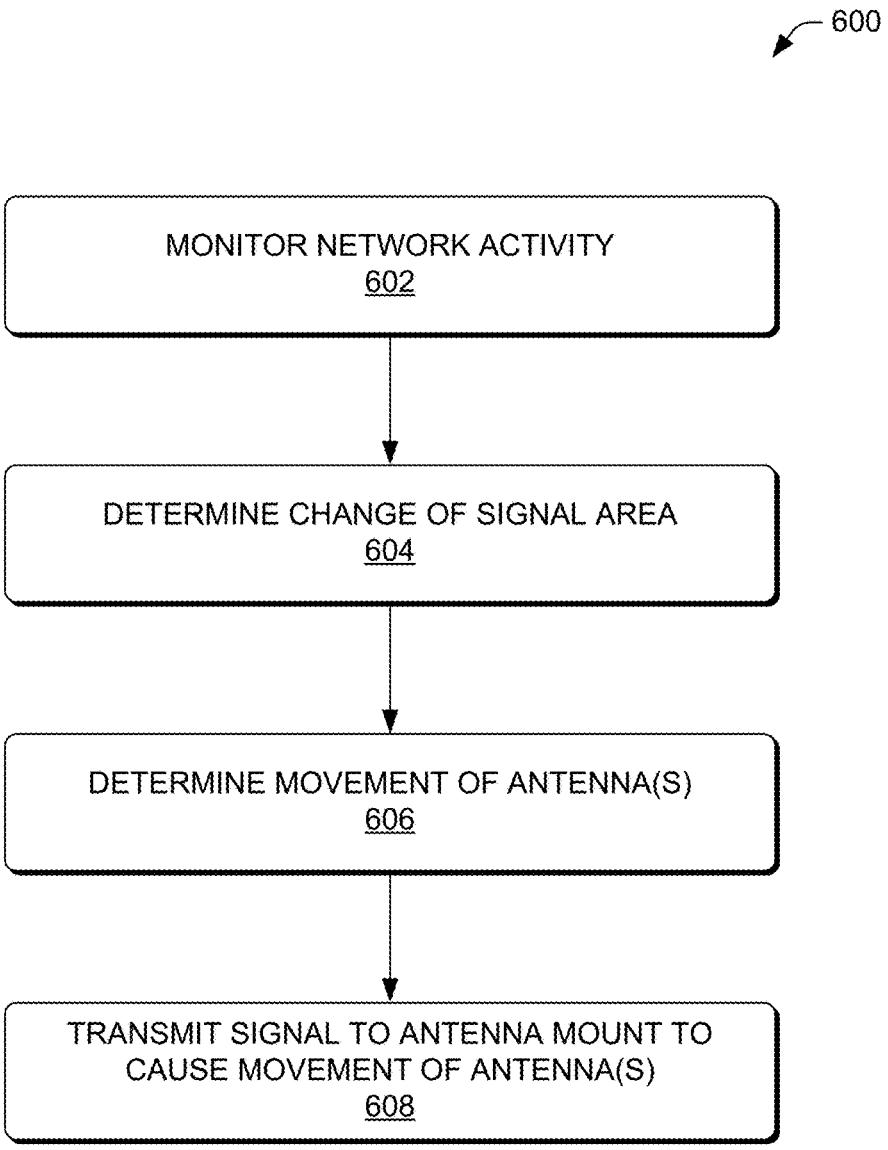
FIG. 6 is a flow diagram of an illustrative process to remotely adjust an azimuth of one or more of the antennas within the fixture.

In some embodiments, the computer-readable media 508 may store a network analyzer 510 and an antenna rotation module 512, each described in turn. The components may be stored together or in a distributed arrangement. The network analyzer 510 may analyze a network to determine coverage needs for different frequency bands of the network, such as the low-band and the mid-band discussed above. The network analyzer 510 may also consider network use and/or other factors when analyzing the network, such as geographic coverage of a mobile telephone network. The network analyzer 510 may provide network information to the antenna rotation module 512, which may determine an azimuth for each antenna within the fixture 100. The antenna rotation module 512 may then transmit a signal to the controller 112 to cause the controller 112 to rotate one or more antenna and thus direct each antenna to an optimal azimuth for a given frequency band. In some embodiments, the network rotation module 512 may make frequent changes to the azimuth for an antenna, possibly similar in amount as the changes to the RET discussed above (e.g., multiple times a day, etc.). FIG. 6 provides additional details about operation of the network analyzer 510 and the antenna rotation module 512.

FIG. 6 is a flow diagram of an illustrative process 600 to remotely adjust an azimuth of one or more of the antennas within the fixture. The process 600 is illustrated as a collection of blocks in a logical flow graph, which represent a sequence of operations that can be implemented in hardware, software, or a combination thereof. In the context of software, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described blocks can be combined in any order and/or in parallel to implement the process. The process 600 is described with reference to the computing environment 500.

At 602, the network analyzer 510 may monitor network activity of a particular network or frequency band of network traffic. For example, the network analyzer 510 may determine that a particular geographic area lacks coverage by an antenna or that a particular geographic area has a large number of users and would benefit from additional coverage by an antenna, such as by offloading some customer traffic to or from another antenna.

At 604, the network analyzer 510 may determine an adjustment of coverage to create better coverage for current users of the network. For example, the network analyzer 510 may determine that movement of main lobes associated with one or more antennas may improve network throughput and/or reduce adverse effects of network traffic, such as dropped calls and/or other errors.

At 606, the network analyzer 510 may determine movement of antennas to achieve the adjustment of coverage determined at the operation 604. For example, the network analyzer 510 may determine that rotation of the first antenna 106(1) by X degrees may offload some network traffic to the antenna 106(1), and thus improve network throughput. Further, the network analyzer 510 may determine not to move the second antenna 106(N), or to rotate the second antenna 106(N) by an amount different than X degrees.

At 608, the antenna rotation module 512 may cause a control signal to be transmitted to the controller 112, which may then cause rotation of the antenna(s) in accordance with the control signal. For example, the controller 112 may cause a stepper motor to rotate a predetermined amount to cause the rotation of a movable mounting device, such as one of the moveable mounting devices 200, 300, or 400 as discussed above. In some embodiments, the antenna rotation module 512 may transmit a signal to a user device to inform a human worker to manually cause rotation of one of the moveable mounting devices, such as by turning a knob or hand crank. After adjustment, the moveable mounting device may be locked in a position to at least temporarily maintain a new azimuth for an adjusted antenna.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. An antenna fixture comprising:

a radome;

a first antenna located within the radome;

a first mounting device rotatably coupled to the radome and located within the radome, the first mounting device coupled to the first antenna and configured to rotate the first antenna about a first axis parallel to a longitudinal axis of the first antenna to modify a first azimuth associated with the first antenna;

a first securing mechanism to at least temporarily lock the first mounting device in place to maintain the first azimuth associated with the first mounting device after rotation of the first mounting device;

a second, different antenna located within the radome; and a second mounting device rotatably coupled to the radome and located within the radome, the second mounting device coupled to the second antenna and configured to rotate the second antenna about a second axis parallel to a longitudinal axis of the second antenna to modify a second azimuth associated with the second antenna;

a second securing mechanism to at least temporarily lock the second mounting device in place to maintain the second azimuth associated with the second mounting device after rotation of the second mounting device, wherein the first mounting device rotates independent from the second mounting device.

2. The antenna fixture as recited in claim 1, wherein the first mounting device includes a support coupled to a hinge located at a first side of the support, the support including a guiding feature located at a second side of the support, the guiding feature configured to translate between a first position and a second position within a fixed guide that constrains movement of the guiding feature and constrains rotation of the hinge.

3. The antenna fixture as recited in claim 1, wherein the first mounting device includes a support configured as a disc that rotates a mount coupled to the disc, wherein the first antenna is coupled to the mount.

4. The antenna fixture as recited in claim 3, further comprising motor to drive a drive wheel that engages the disc, the motor to cause controlled rotation of the disc having the support and the first antenna.

5. The antenna fixture as recited in claim 1, further comprising:

a controller to receive a control signal indicating a rotation of the first antenna; and a motor to cause rotation of the first mounting device, the motor to receive power from the controller in response to the control signal indicating the rotation of the first antenna.

6. The antenna fixture as recited in claim 1, wherein the first antenna is a low-band frequency cell site antenna and the second antenna is a mid-band frequency cell site antenna.

7. An apparatus comprising:

a housing;

a first mounting device rotatably coupled to a housing, the first mounting device coupled to a first antenna and configured to rotate the first antenna to modify a first azimuth associated with the first antenna; and a second mounting device rotatably coupled to the frame, the second mounting device coupled to a second antenna and configured to rotate the second antenna to modify a second azimuth associated with the second antenna;

at least one securing mechanism to at least temporarily lock at least one of the first mounting device or the second mounting device to prevent rotation of the at least one the first mounting device or the second mounting device, wherein the first mounting device rotates independent from the second mounting device.

8. The apparatus as recited in claim 7, further comprising a motor to cause rotation of at least the first mounting device about an axis that is parallel to a longitudinal axis of the first antenna.

9. The apparatus as recited in claim 7, further comprising a controller to receive a control signal indicating a rotation of the first antenna, and wherein the controller causes actuation of the motor.

10. The apparatus as recited in claim 7, wherein the motor drives a gear that engages teeth of the first mounting device to cause rotation of the first mounting device, and wherein the motor is a stepper motor.

11. The apparatus as recited in claim 7, further comprising a knob to cause rotation of at least the first mounting device about an axis that is parallel to a longitudinal axis of the first antenna.

12. The apparatus as recited in claim 11, further comprising indicia on the knob to indicate an amount of rotation of the first antenna.

13. The apparatus as recited in claim 7, wherein the first mounting device includes a support coupled to a hinge located at a first side of the support, the support including a guiding feature located at a second side of the support, the guiding feature configured to move between a first position and a second position within a fixed guide that constrains movement of the guiding feature and constrains rotation of the hinge.

14. The apparatus as recited in claim 13, wherein the guiding feature further includes a motor to cause controlled movement of the second side of the support with respect to the guide.

15. The apparatus as recited in claim 7, wherein an axis of rotation of the first antenna is parallel to a longitudinal axis of the first antenna.

16. A system comprising:

a housing;

a mounting fixture including:

a first mounting device rotatably coupled to a housing, the first mounting device coupled to a first antenna and configured to rotate the first antenna to modify a first azimuth associated with the first antenna;

a second mounting device rotatably coupled to the frame, the second mounting device coupled to a second antenna and configured to rotate the second antenna to modify a second azimuth associated with the second antenna;

at least one securing mechanism to at least temporarily lock at least one of the first mounting device or the second mounting device to prevent rotation of the at least one the first mounting device or the second mounting device; and one or more actuators to cause independently controlled rotation of the first mounting device and the second mounting device; and a controller to activate at least one of the one or more actuators to cause the independently controlled rotation of the first antenna, the second antenna, or both.

17. The system as recited in claim 16, wherein the controller receives a signal from a switch center, the signal indicating a change in an azimuth of at least the first mounting device or the second mounting device.

18. The system as recited in claim 16, wherein an axis of rotation of the first antenna is parallel to a longitudinal axis of the first antenna.

19. The system as recited in claim 16, further comprising the first antenna and the second antenna.

20. The system as recited in claim 16, wherein the first mounting device includes a support coupled to a hinge located at a first side of the support, the support including a guiding feature located at a second side of the support, the guiding feature configured to move between a first position and a second position within a fixed guide that constrains movement of the guiding feature and constrains rotation of the hinge.

* * * * *